US007841198B2

(12) United States Patent
Bippus et al.

(10) Patent No.: US 7,841,198 B2
(45) Date of Patent: Nov. 30, 2010

(54) ICE MAKER WITH WATER QUANTITY SENSING

(75) Inventors: Melissa Marie Bippus, Evansville, IN (US); John P. Tinney, St. Joseph, MI (US); Ravindra S. Kavchale, Lexington, KY (US); Matthew E. Herr, Chandler, IN (US); Beth Michelle Gehlhausen, Velpen, IN (US); Gregory Urban Schmitt, Wadesville, IN (US); Brian Joseph Beuligmann, Evansville, IN (US); Roger Urban Merkel, Evansville, IN (US)

(73) Assignee: Whirpool Corporation, Benton Harbor, MI (US)

( * ) Notice: Subject to any disclaimer, the term of this patent is extended or adjusted under 35 U.S.C. 154(b) by 438 days.

(21) Appl. No.: 11/458,189

(22) Filed: Jul. 18, 2006

(65) Prior Publication Data

US 2008/0016900 A1 Jan. 24, 2008

(51) Int. Cl.
*F25C 1/00* (2006.01)

(52) U.S. Cl. ..... 62/233; 62/348

(58) Field of Classification Search ..... 62/348, 62/344, 347, 233, 135, 138, 66, 214; 261/DIG. 46
See application file for complete search history.

(56) References Cited

U.S. PATENT DOCUMENTS 3,707,334 A * 12/1972 Ohlsson et al. ..... 415/121.3
4,319,698 A * 3/1982 Tomiyama et al. ..... 222/129.1
4,550,572 A 11/1985 Schulze-Berge
4,619,117 A * 10/1986 Ito ..... 62/233
4,662,183 A * 5/1987 Keller ..... 62/138
4,785,641 A 11/1988 McDougal
5,239,836 A * 8/1993 Sakai ..... 62/233
5,263,337 A 11/1993 McMillan et al.
5,289,691 A * 3/1994 Schlosser et al. ..... 62/78
5,408,834 A 4/1995 Schlosser et al.
5,586,439 A 12/1996 Schlosser et al.
5,752,393 A 5/1998 Schlosser et al.
6,000,228 A 12/1999 Johnson et al.
6,112,533 A 9/2000 Kato et al.

(Continued)

OTHER PUBLICATIONS

Notification of Transmittal of International Search Report and Written Opinion- Dec. 18, 2007.

*Primary Examiner*—Mohammad M Ali
(74) *Attorney, Agent, or Firm*—John W. Morrison; Greer, Burns & Crain Ltd

(57) ABSTRACT

An ice maker includes a refrigeration system for cooling an ice forming surface, a water supply inlet and an inlet valve arranged to selectively admit and prevent admission of water from the inlet. A flow sensor at the inlet valve determines a volume of water admitted through the water supply inlet. An operating position of the water supply inlet valve is based upon input from the flow sensor. A water collecting device receives a supply of water from the water supply inlet through the water supply inlet valve and receives a flow of water from the ice forming surface. A recirculating pump is connected to the water collecting device and to a recirculating passage arranged to direct water toward the ice forming surface. A level sensor at the water collecting device determines a level of water in the water collecting device. A discharge pump is connected to the water collecting device, and the control selectively operates the discharge pump based upon input from the level sensor.

15 Claims, 9 Drawing Sheets

U.S. PATENT DOCUMENTS 6,145,324 A * 11/2000 Dolezal ..... 62/73
6,153,105 A * 11/2000 Tadlock et al. ..... 210/650
6,567,805 B1 5/2003 Johnson et al. ..... 707/5
6,650,456 B2 11/2003 Judd et al. ..... 359/245
6,651,455 B1 11/2003 Yoho et al.
6,732,080 B1 5/2004 Blants ..... 705/9
6,892,081 B1 5/2005 Elomaa ..... 455/575.1
6,952,937 B2 * 10/2005 Choi et al. ..... 62/347
7,210,601 B2 * 5/2007 Hortin et ..... 222/144.5
2002/0187775 A1 12/2002 Corrigan et al. ..... 455/414
2004/0112970 A1 * 6/2004 Feldmeth et al. ..... 236/20 R
2005/0241329 A1 * 11/2005 Castrellon et al. ..... 62/340
2007/0119193 A1 * 5/2007 Davis et al. ..... 62/135

* cited by examiner

ICE MAKER WITH WATER QUANTITY SENSING

BACKGROUND OF THE INVENTION

The present invention relates generally to ice makers.

Ice makers, particularly those used in homes and small businesses are well known and employ a refrigeration system to chill an ice forming surface below the freezing temperature of water. Such refrigeration systems typically include a compressor, an evaporator and a condenser all connected by refrigerant lines. The ice forming surface is thermally connected to the evaporator and is chilled to a temperature below the freezing temperature of water, then a supply of water is dispensed onto this surface and allowed to freeze. In some systems, the water is dispensed onto the surface and all of the dispensed water is held there until it has frozen into ice. In other systems, the water flows over the chilled surface and some turns to ice and the remainder is collected and recirculated. Such a system is disclosed in U.S. Pat. No. 4,009,595 which was assigned to the assignee hereof, and which is incorporated herein by reference.

A problem that develops with ice makers is that minerals in the water, and particularly calcium, form deposits on the ice forming surface, decreasing the thermal transfer effectiveness of the ice forming surface, thereby decreasing the effectiveness and energy efficiency of the ice maker, as well as causing the ice to be retained on the ice forming surface rather than being released from that surface during harvesting of the formed ice. This requires the ice forming surface to be cleaned on a regular basis to remove these deposits.

Also, the recirculation pump which is used to supply water to the ice forming surface is subject to corrosion from the minerals in the water being recirculated. As the water freezes onto the ice forming surface, the remaining recirculating water become rich in minerals, increasing the problem. It is known, for example as disclosed in U.S. Pat. No. 4,785,641, to operate a discharge pump for a predetermined period of time to flush remaining water from the reservoir prior to each ice making cycle and to allow the ice forming surface to cool to below freezing temperature before water is circulated over the ice forming surface.

U.S. Pat. No. 6,000,228 discloses an ice making apparatus in which water is supplied through a water valve for a predetermined time period. Water is circulated by a pump from a water sump to an ice forming surface for a second predetermined time period. The sump is drained via gravity through a drain valve for a third predetermined time period.

It would be an improvement in the art if an ice making apparatus and method were provided wherein less water is used during the process of forming a given batch of ice and fresh water is provided for each new batch of ice.

SUMMARY OF THE INVENTION

The present invention provides an ice making apparatus and method wherein less water is used during the process of forming a given batch of ice than in other available ice making systems and fresh water is provided for each new batch of ice.

In an embodiment of such an ice making apparatus, there is provided a refrigeration system for cooling an ice forming surface below a freezing temperature of water, a water supply inlet, a water supply inlet valve arranged to admit water from the water supply inlet when in an open position and to prevent admission of water from the water supply inlet when in a closed position, and a flow sensor associated with the water supply inlet valve to determine a volume quantity of water admitted through the water supply inlet. A control is arranged to control a position of the water supply inlet valve based upon input from the flow sensor. A water collecting device is connected to receive a supply of water from the water supply inlet through the water supply inlet valve and is arranged to receive a flow of water from the ice forming surface. A recirculating pump has an inlet connected to the water collecting device, and a recirculating passage is connected at a first end to an outlet of the recirculating pump and is arranged to direct water toward the ice forming surface.

In an embodiment, a user interface is associated with the control to permit a user to select different volumes of water to be admitted to the water collecting device through the inlet valve to produce ice bodies having selected thicknesses.

In another embodiment of such an ice making apparatus, there is provided a refrigeration system for cooling an ice forming surface below the freezing temperature of water, a water supply inlet, a water collecting device connected to receive a supply of water from the water supply inlet and arranged to receive a flow of water from the ice forming surface. A level sensor is associated with the water collecting device to determine a water quantity based on a level of water in the water collecting device. A recirculating pump has an inlet connected to the water collecting device and a recirculating passage is connected at a first end to an outlet of the recirculating pump and is arranged to direct water toward the ice forming surface. A discharge pump is provided having an inlet connected to the water collecting device, and a control is arranged to selectively operate the discharge pump based upon input from the level sensor.

In an embodiment, the recirculating pump and the discharge pump are one and the same.

In an embodiment, a valve is provided on a downstream side of the pump, operated by the control, to selectively direct water from the pump to the ice forming surface or to a drain.

In an embodiment, the pump is a reversible pump.

In an embodiment, the discharge pump is a submersible pump positioned in the water collecting device.

In an embodiment, the control is further arranged to selectively operate the recirculating pump based on input from the level sensor.

In an embodiment, the control is further arranged to initiate an ice harvesting routine based on input from the level sensor.

In an embodiment, the control includes a counter and a time within ice freezing routines is measured.

In an embodiment, the control is further arranged to generate an error signal upon detection of a predetermined number of instances of the time between successive ice harvesting routines being outside of a predetermined range of times.

In an embodiment, a water supply inlet valve is arranged to admit water from the water supply inlet when in an open position and to prevent admission of water from the water supply inlet when in a closed position, and the control is arranged to control a position of the water supply inlet valve based upon input from the flow sensor.

In an embodiment, the invention provides a method of operating an ice maker including the following steps:

setting a desired ice layer thickness on a user interface of a control, opening a water supply inlet valve to admit water from a water supply inlet, directing the admitted water into a water collecting device, sensing a volume of water being admitted through the water supply inlet, closing the water supply inlet valve based upon the sensed volume of water admitted through the water supply inlet and the set desired ice layer thickness, cooling an ice forming surface below the freezing temperature of water, pumping water from the water collecting device through a recirculating passage to the ice forming surface via a recirculating pump, and directing unfrozen water from the ice forming surface back to the water collecting device.

In an embodiment, the method includes the further steps of:

sensing a level of water in the water collecting device with a level sensor, and pumping water from the water collecting device via a discharge pump to a drain based upon input from the level sensor.

In an embodiment, the method includes the further step of:

terminating operation of the discharge pump based upon an input from the level sensor.

In an embodiment, the step of pumping via a recirculating pump and the step of pumping via a discharge pump utilize the same pump.

In an embodiment, the method includes the steps of:

operating the pump in a first direction to pump water to the ice forming surface, and operating the pump in a second, opposite direction to pump water to the drain.

In an embodiment, the step of setting a desired ice layer thickness comprises selecting between a thin layer, a thick layer and an intermediate thickness layer.

In an embodiment, the method includes the steps of:

sensing a level of water in the water collecting device with a level sensor, and initiating an ice harvesting routine based upon input from the level sensor.

In an embodiment, the method includes the steps of:

measuring a time within ice freezing routines, and displaying a warning signal when a number of occurrences falls above a predetermined set point.

These and other aspects and details of the present invention will become apparent upon a reading of the detailed description and a review of the accompanying drawings. Specific embodiments of the present invention are described herein. The present invention is not intended to be limited to only these embodiments. Changes and modifications can be made to the described embodiments and yet fall within the scope of the present invention.

DETAILED DESCRIPTION OF THE PREFERRED EMBODIMENTS

The present invention finds particular utility in an ice maker which may be in the form of a stand alone appliance, or which may be incorporated into another appliance, such as a refrigerator or freezer appliance. Although the embodiment described below is illustrated as a stand alone appliance, the invention should not be limited to such an arrangement.

Figure 1:
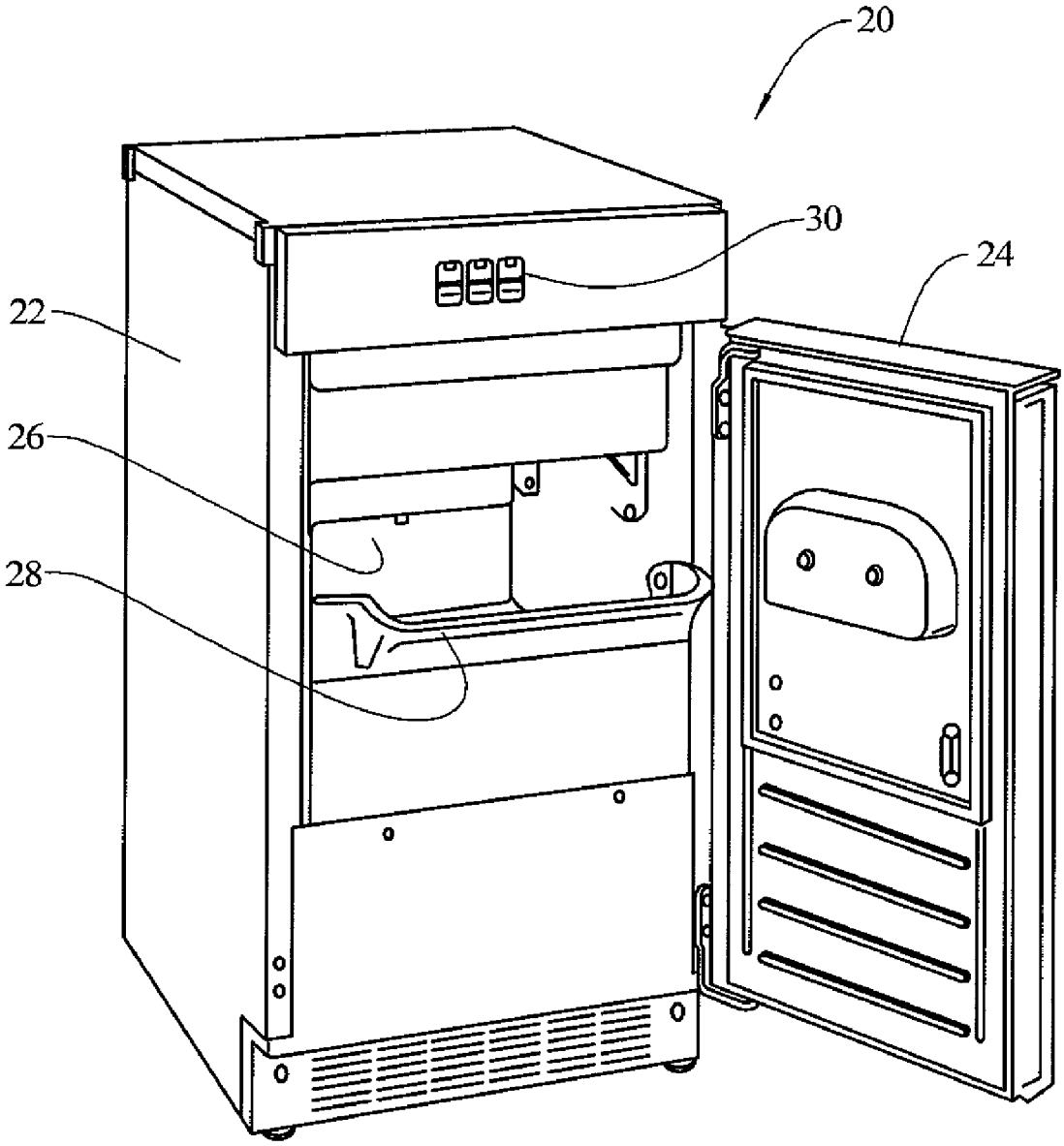
FIG. 1 is a perspective view of an ice maker embodying the principles of the present invention.

FIG. 1 is a perspective view of an ice maker 20 in which an embodiment of the invention may be practiced. This ice maker has a cabinet 22 for housing various components of the ice maker, and also includes a door 24 providing access to an interior 26 of the ice maker, particularly for retrieving ice stored in an ice storage bin 28. A plurality of user interface devices 30 are provided on the exterior of the cabinet 22 to allow a user to selectively control various aspects of the operation of the ice maker.

Figure 2:
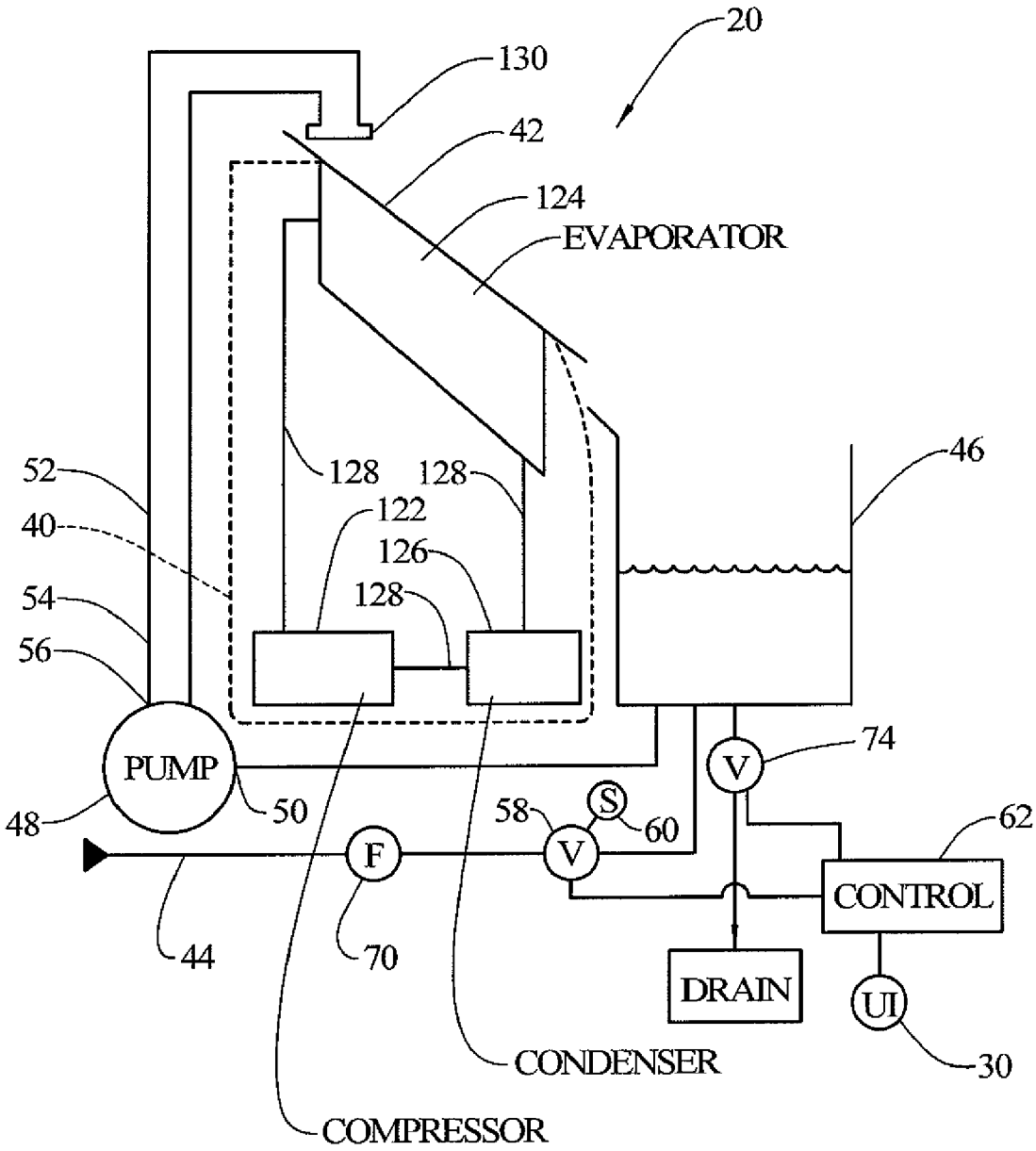
FIG. 2 is a schematic view of an ice maker embodying the principles of the present invention.

The components of an embodiment of an ice maker 20 embodying the principles of the present invention are illustrated schematically in FIG. 2. In this embodiment, the ice maker 20 comprises a refrigeration system 40 for cooling an ice forming surface 42 below the freezing temperature of water and a water supply inlet 44. A water collecting device 46 is connected to receive a supply of water from the water supply inlet 44 and is arranged to receive a flow of water from the ice forming surface 42. A recirculating pump 48 has an inlet 50 connected to the water collecting device 46. A recirculating passage 52 is connected at a first end 54 to an outlet 56 of the recirculating pump 48 and is arranged to direct water toward the ice forming surface 42.

In an embodiment, the ice maker 20 may include a water supply inlet valve 58 associated with the water supply inlet 44. A flow sensor 60 may be associated with the water supply inlet valve 58 to determine a volume of water admitted through the water supply inlet 44. A control 62 is arranged to control a position of the water supply inlet valve 58 based upon input from the flow sensor 60. One of the user interface devices 30 may be associated with the control 62 to permit a user to select different volumes of water to be admitted to the water collecting device 46 through the inlet valve 58. For example, the user may select via the user interface device 30 one of thick, thin or normal (intermediate between thick and thin) for a thickness of the ice slab or ice body formed by the ice maker 20.

Figure 3:
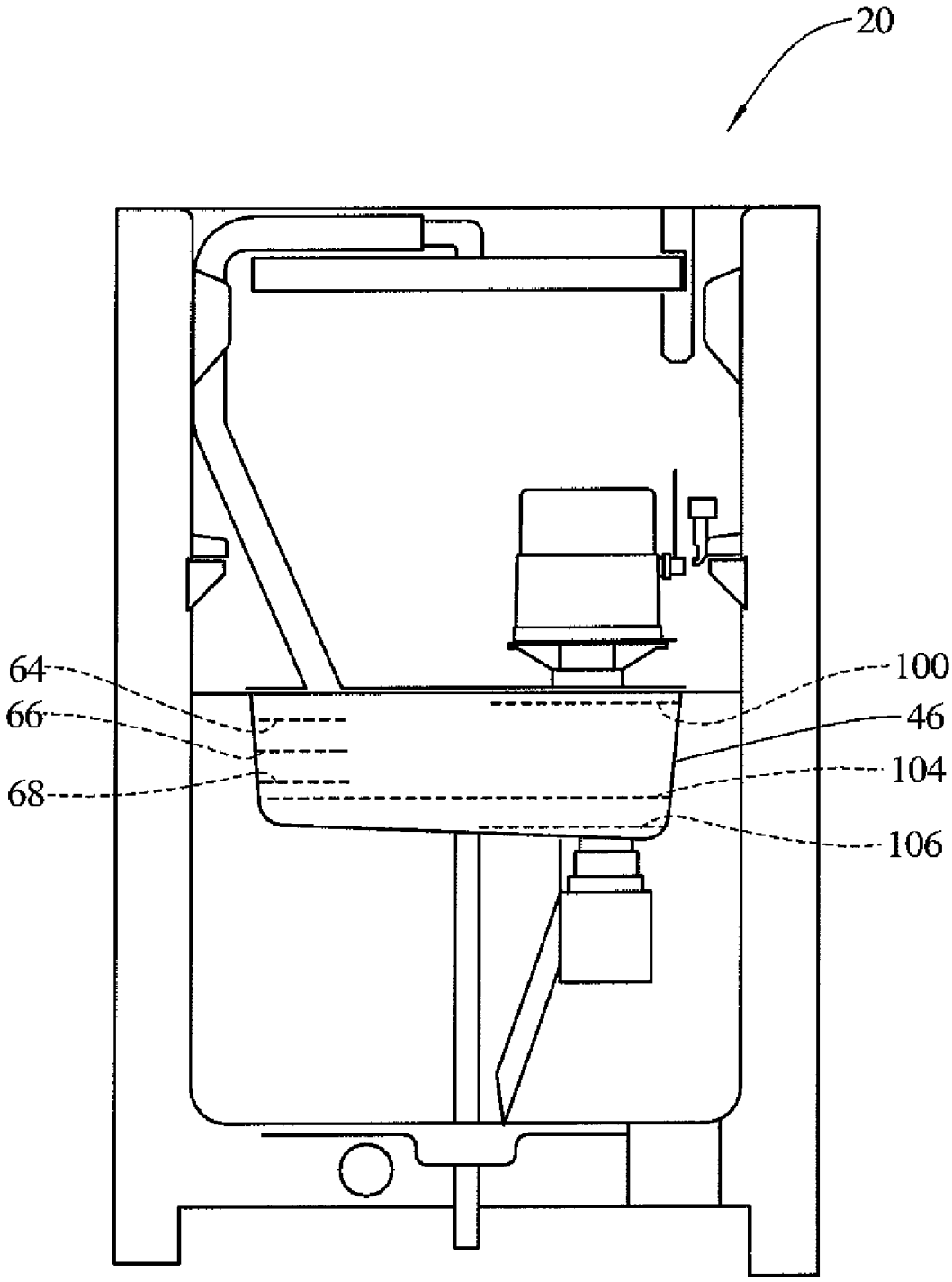
FIG. 3 is an elevational view of a water collecting and draining device in an embodiment of the present invention.

Upon receipt of the user's selection, the control 62 will operate the water supply inlet valve 58 to open long enough for the flow sensor 60 to determine that a volume of water sufficient to provide such a selected thickness of ice has been admitted to the water collecting device 46. As shown in FIG. 3, the result of this measured water introduction, the water collecting device 46 would be filled to an upper level 64 for a thick ice slab, to an intermediate level 66 for a normal thickness ice slab and to a lower level 68 for a thin ice slab. By having the flow sensor 60 and the inlet valve 58 only allow in enough water to make the ice slab, this will keep the amount of water wasted to a minimum. Currently large amounts of water are allowed into the ice forming appliance and then just overflowed to the drain. This reduction in water consumption will also make filtering the water more feasible. Currently the appliance uses too large a quantity of water for a small filter to be feasible without requiring that the filter be changed very frequently. The use of just the right amount of water will allow for the use of a smaller, and therefore less costly filter 70 (FIG. 2) to be used, and will result in less frequent changing of the filter.

During the ice forming process, the water from the water collecting device 46 will be continuously recirculated over the ice forming surface 42 until all of the available water has been frozen. The recirculation of all of the available water from the water collecting device 46 may be accomplished in several different ways.

One way is simply to run the recirculating pump 48 for a sufficient period of time to completely freeze all of the water contained in the water collecting device 46 onto the ice slab forming on the ice forming surface 42. One drawback that this arrangement has is that the final amount of water would have an extra high concentration of minerals in it and could make the resulting ice slab cloudy rather than clear.

Another way to recirculate all of the available water to achieve the selected thickness would be to connect the inlet for the recirculating pump 48 at a position above the bottom of the water collecting device 46 and then run it for a sufficiently long and predetermined period of time. In this manner, all of the water above that point would be available for recirculation, and a defined volume above that point could be selected through the use of the interface device 30. There would still be some water remaining in the water collecting device 46 after the recirculating pump 48 had pumped out all of the water above the inlet point, and the mineral concentration could be present in this remaining water, rather than being forced to remain in the last of the water frozen on the ice forming surface 42.

A third way to recirculate all of the available water to achieve the selected thickness would be to utilize a sensor 72, as described below with respect to FIG. 6, to terminate operation of the recirculation pump 48 when the water level in the water collecting device 46 drops to a certain predetermined level. In this arrangement, there would still be some water remaining in the water collecting device 46 after the recirculating pump 48 had pumped out all of the water above the predetermined level, and the mineral concentration could be present in this remaining water, rather than continuously being applied to the ice forming surface 42 until frozen there with the last of the water.

Figure 4:
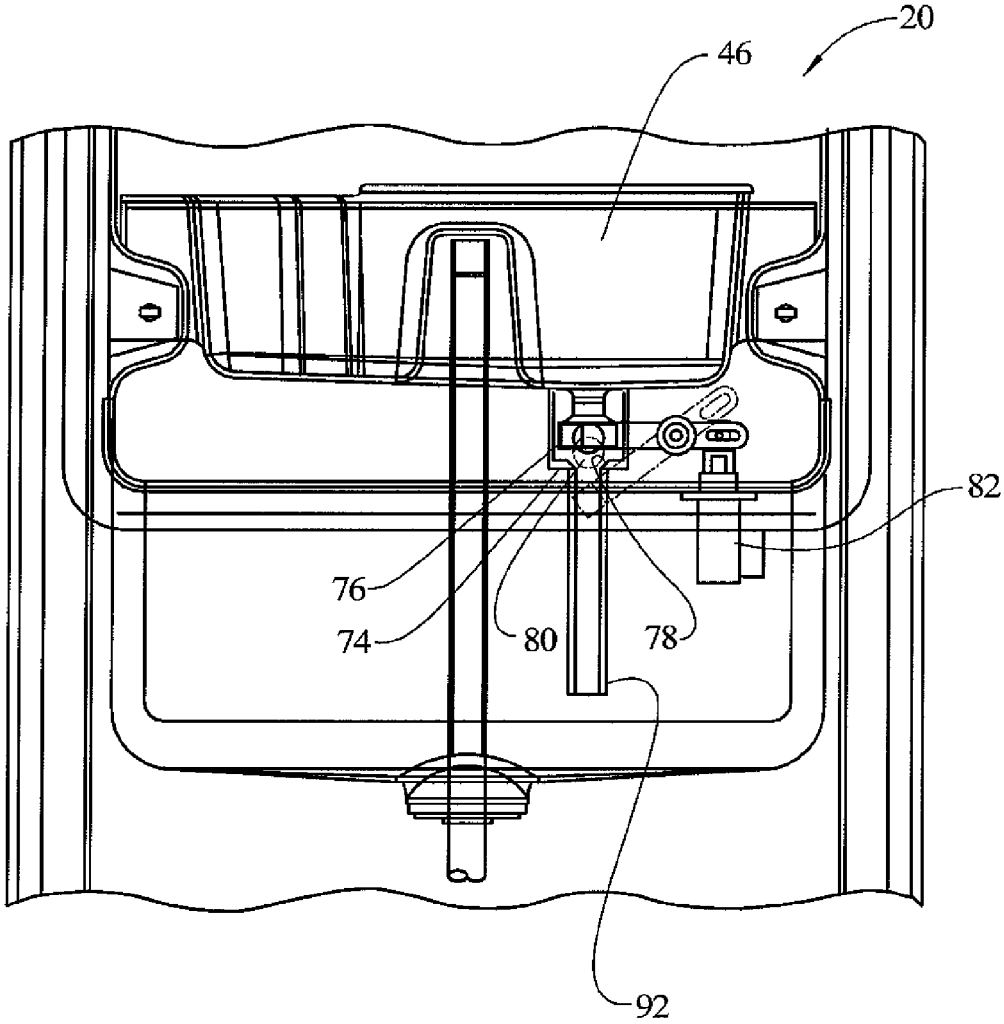
FIG. 4 is an elevational view of an alternative embodiment of a drain device utilized in an embodiment of the present invention.

A drain device 74 could be utilized with the water collecting device, and operated by the control 62. The drain device 74, as shown in FIG. 4 could comprise a controllable drain valve 76 which could be opened by the control 62 to empty the water collecting device 46 at the beginning of each ice harvest mode and as part of a standard flush mode or cleaning mode. In this manner, each new ice forming cycle would begin with a supply of fresh water, and all accumulated minerals concentrated in the unfrozen water could be flushed or drained from the water collecting device 46.

Figure 5:
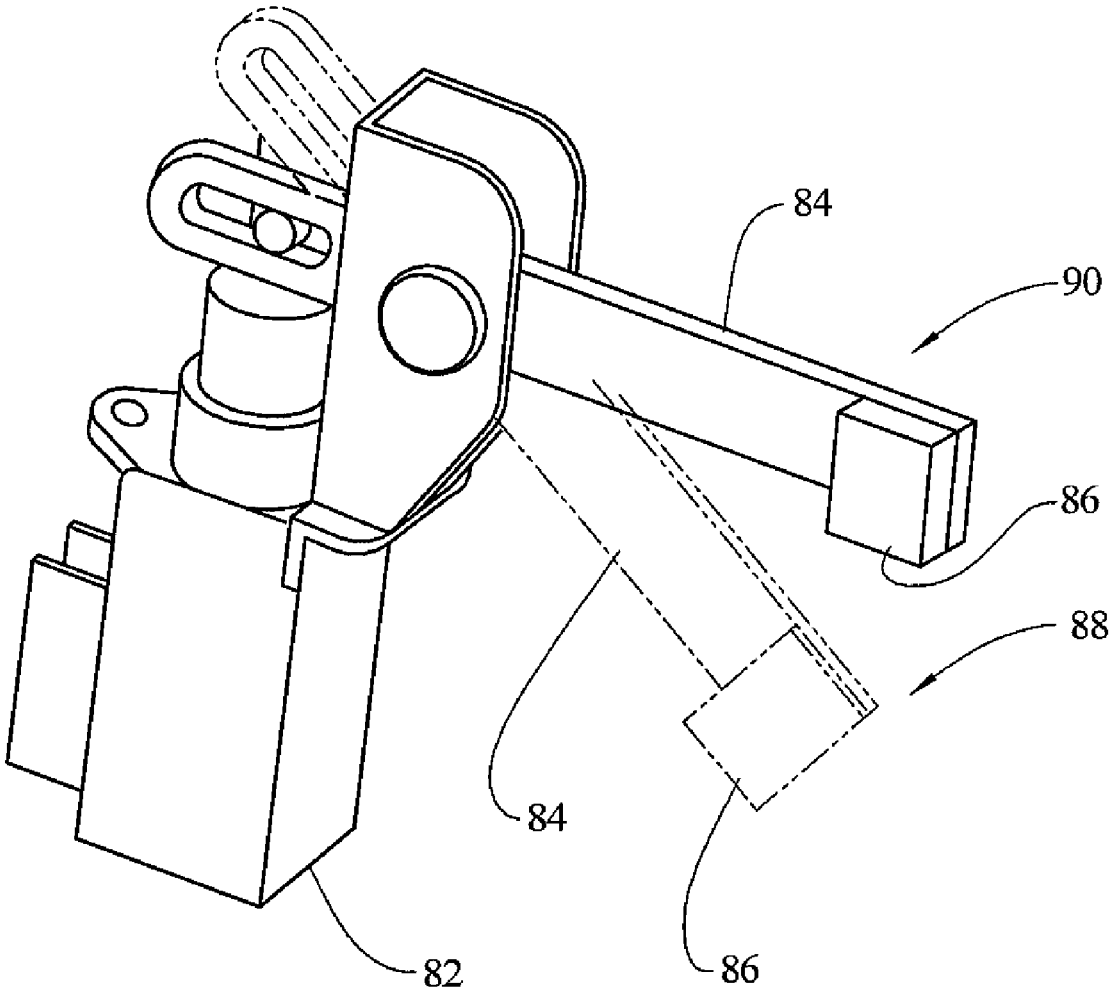
FIG. 5 is a perspective view of a drain valve motor utilized in an embodiment of the present invention.

An embodiment of such a drain device 74 is illustrated in FIGS. 4 and 5 showing a drain valve 76 comprising simply a valve seat 78 with a corrosion resistant, yet magnetizable valve ball 80 seated in the valve seat by means of gravity. A simple motor 82, such as a wax motor, could be used to rotate an arm 84 carrying a magnet 86 between a lower position 88 being at or below the valve seat 78 and an upper position 90 being above the valve seat. When the motor 82 moves the magnet 86 to the upper position 90, the ball 80 will be moved up off of the seat 78, allowing the water in the water collecting device 46 to flow past the ball and the valve seat and through a drain conduit 92 to the drain. When the motor 82 moves the magnet 86 to the lower position 88, the ball 80 will be allowed to seat on the valve seat 78, allowing the water collecting device 46 to refill with fresh water. With this type of drain device 74, the operative and movable parts of the drain valve 76, other than the valve ball 80, remain outside of the flow or contact with the water, and therefore are not subject to corrosion or fouling, thereby increasing the reliability and life of the drain device. Other well known types of drain devices 74 in which the drain conduit 92 is selectively opened or closed, may be utilized as well.

Figure 6:
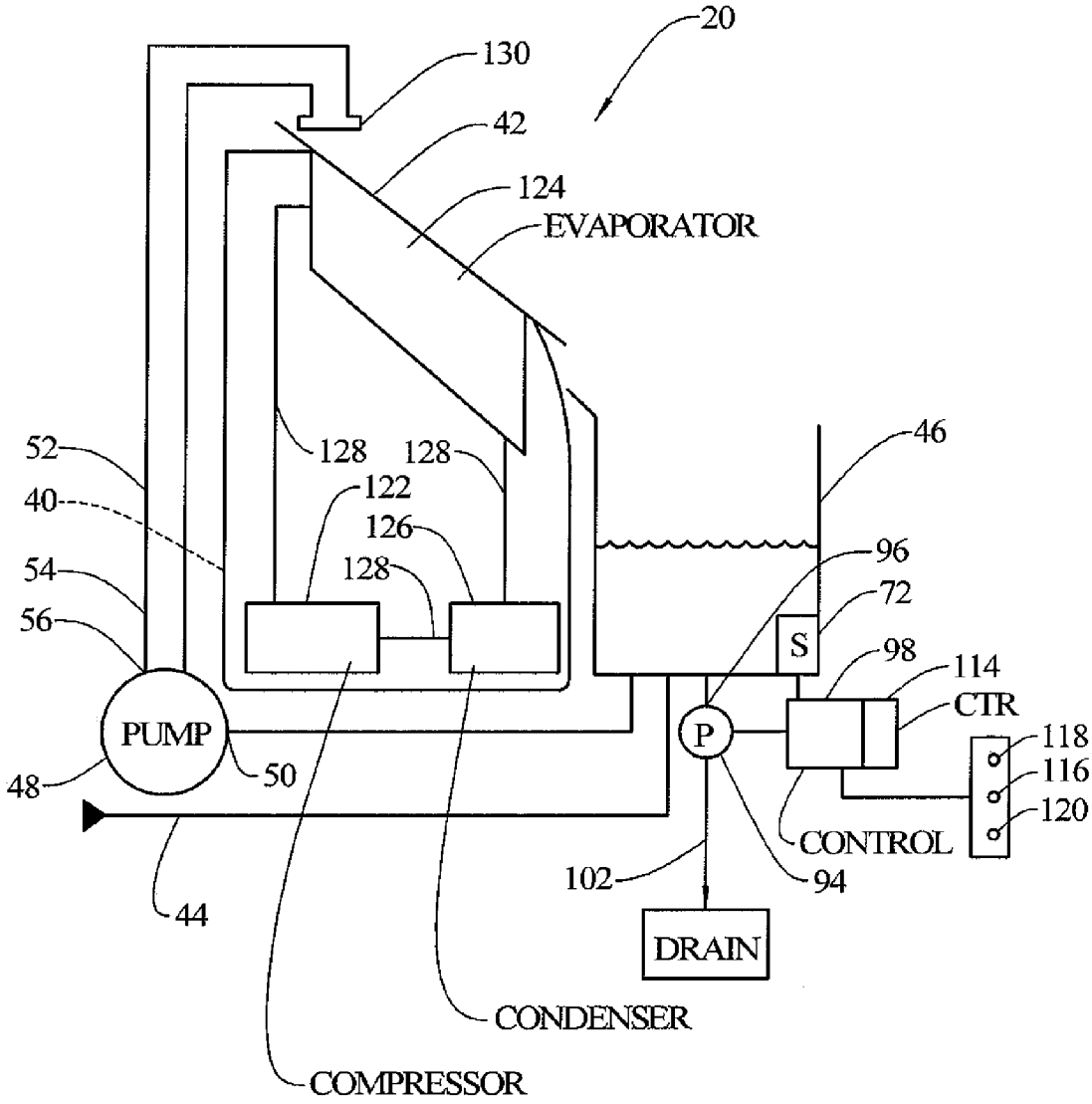
FIG. 6 is a schematic view of an alternative embodiment of an ice maker embodying the principles of the present invention.

In an embodiment as illustrated in FIG. 6, the ice maker 20 may include the level sensor 72 associated with the water collecting device 46 to determine a level of water in the water collecting device, a discharge pump 94 having an inlet 96 connected to the water collecting device 46, and a control 98 arranged to selectively operate the discharge pump based upon input from the level sensor. This embodiment may be used in conjunction with or independent of the water supply inlet valve 58 and flow sensor 60 described above.

The level sensor 72 may be used to sense several different levels and different actions could follow based upon the sensed levels. For example, and referring to FIG. 3, if the water level in the water collecting device 46 reached an uppermost level 100, which may equate with an overflow level, the control 98 could cause the discharge pump 94 to begin pumping water from the water collecting device to a drain conduit 102. This level 100 might be intentionally reached in order to flush out the water collecting device 46 on occasion.

Further, a second level 104 detected by the level sensor 72 might be selected to terminate operation of the recirculation pump 48. As discussed above, use of a level sensor for this level 104 will cause the recirculation pump 48 to stop pumping before all of the water, with the more concentrated minerals, is caused to freeze on the ice forming surface 42. A further benefit of detecting this level 104 (FIG. 3) would be to cause a termination of the operation of the recirculation pump 48 before that pump begins making a cavitating noise due to running without water. If such a noise is allowed to occur, a user of the appliance may make an unnecessary service call, believing that some problem with the appliance existed.

The level sensor 72 might also be used to detect a lowermost level 106 (FIG. 3) of water in the water collecting device 46 representing a level that equates with the water collecting device essentially being completely drained. A signal from the level sensor 72 indicating that this level has been reached could be used by the control to terminate operation of the discharge pump 94. A further benefit of detecting this level 106 would be to cause a termination of the operation of the discharge pump 94 before that pump begins making a cavitating noise due to running without water. If such a noise is allowed to occur, a user of the ice maker appliance 20 may make an unnecessary service call, believing that some problem with the appliance existed.

As mentioned above, the use of the level sensor 72 could be in combination with the flow sensor 60 or the use could be independent. When used in combination, the flow sensor 60 could be used with the water inlet control valve 58 to admit water to the water collecting device to achieve one of the three levels 64, 66 and 68 to achieve a user selected thickness for the ice bodies. The level sensor 72 could be used to terminate recirculation of the water to the ice forming surface 42 when the water in the water collecting device 46 reached the level 104. The discharge pump 94 could then be energized to pump out the remaining water until the level sensor 72 sensed that the water level in the water collecting device had reached the lowermost level 106, at which point the discharge pump would be deenergized.

Alternatively, instead of using the flow sensor 60 for filling the water collecting device 46 to the desired level (64, 66, 68), the level sensor 72 could also be used to sense these levels as well and to send the appropriate signal to the control 98 to close the water inlet valve 58 at the appropriate time.

The level sensor 72 could be a single sensor sending out a varying signal to the control 98 for the various levels identified above, or separate sensors could be utilized, which each arranged to send an appropriate signal when their particular level is detected.

Figure 7:
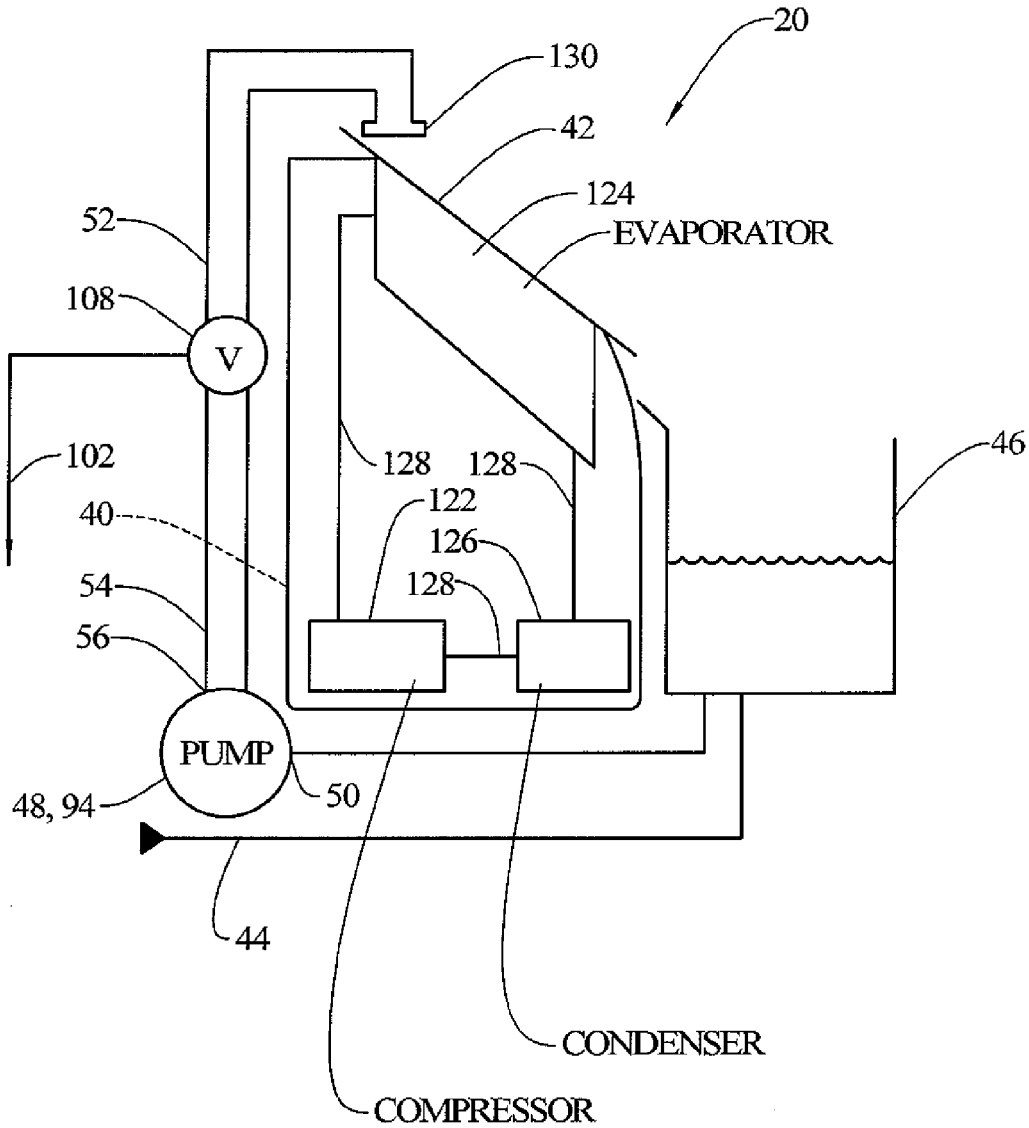
FIG. 7 is a schematic view of an alternative embodiment of an ice maker embodying the principles of the present invention.

In an embodiment as illustrated in FIG. 6, the recirculating pump 48 and the discharge pump 94 may be separate pumps, while in other embodiments as illustrated in FIG. 7, the recirculating pump 48 and the discharge pump 94 may be one and the same. Similarly, the controls 62, 98 could be separate control components, or may a part of a single control component.

Figure 8:
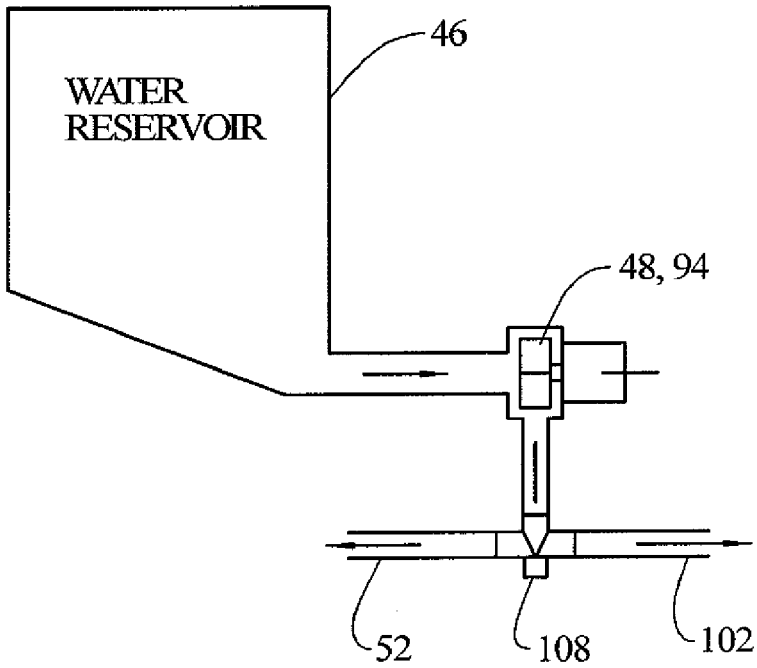
FIG. 8 is a schematic view of an embodiment of the pump and valve arrangement for an embodiment of the present invention.

In an embodiment as illustrated in FIG. 7, where the recirculating pump 48 and the discharge pump 94 are the same, a valve 108 may be provided on a downstream side of the pump 48, 94, operated by the control 98 to selectively direct water from the pump to the ice forming surface 42 or to the drain conduit 102. When the pump 48,94 is a unidirectional pump, as illustrated in FIG. 8, the valve 108 could be a solenoid T-valve, for example, so that when the pump is to act as the recirculating pump, the valve 108 could be moved to cause water to flow into the recirculation conduit 52 and when the pump is to act as the discharge pump, the valve could be used to cause water to flow towards the drain conduit 102. Alternatively, two solenoid valves could be used, each one being independently operated in the appropriate flow paths.

Figure 9:
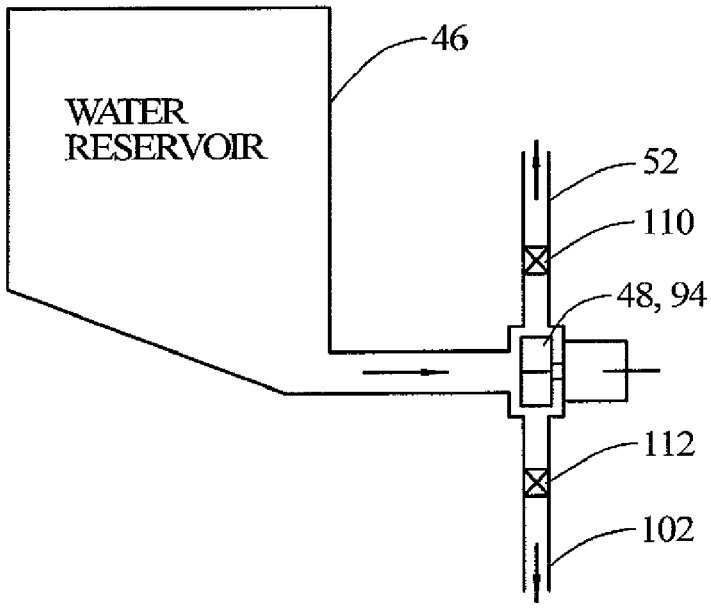
FIG. 9 is a schematic view of an alternative embodiment of the pump and valve arrangement for an embodiment of the present invention.

In an arrangement where the recirculating pump 48 and the discharge pump 94 are the same, and the pump is a reversible pump, as illustrated in FIG. 9, a check valve 110, 112 can be placed in the conduits 52, 102 on both sides of the pump. In this manner, when the pump 48,94 is operating in a first direction as the recirculating pump, the valve 110 on the downstream side of the pump will be in the recirculating conduit 52, and will automatically open, allowing water to pass. The check valve 112 on the upstream side of the pump 48,94 will be in the drain conduit 102 and will automatically close to prevent air from being sucked from the drain into the pump. Alternatively, when the pump 48,94 is being operated as the discharge pump, the check valve 112 on the downstream side of the pump will now be the one in the drain conduit 102 and it will automatically open, allowing the water to pass to the drain. The check valve 110 on the upstream side of the pump 48,94 will be in the recirculating conduit 52 and will automatically close to prevent air from being sucked from the area of the ice forming surface 42 into the pump.

In an embodiment, either or both of the recirculating pump 48 and the discharge pump 94 may be a submersible pump positioned in the water collecting device 46. Alternatively, the recirculating pump 48 and/or the discharge pump 94 may be located outside of the water collecting device 46. If either or both of the pumps 48,94 are located in the water collecting device 46 as submersible pumps, then a sump area of the water collecting device 46 will need to be enlarged to accommodate the volume consumed by the pumps. If one or both pumps 48, 94 are made submersible, potential corrosion of the motor would be reduced or avoided since the motor would be in a sealed case rather than being exposed to air, high humidity and other environmental factors.

In an embodiment, the control 98 may be arranged to selectively operate the recirculating pump 48 based on input from the level sensor 72. Specifically, once the level sensor 72 detects that the water level in the water collecting device 46 has dropped to the level 104, then the operation of the recirculating pump 48 could be terminated by the control 98.

In an embodiment, the control 98 may be arranged to initiate an ice harvesting routine based on input from the level sensor 72. The ice harvesting routine could begin when the operation of the recirculating pump 48 is terminated, which could be controlled by the control 98 upon receiving a signal from the level sensor 72 that the water level in the water collecting device 46 has dropped to the level 104. A standard ice harvesting routine could be utilized, which includes directing warm refrigerant to the ice forming surface 42 to melt a layer of ice formed directly at the surface, to allow the formed ice slab to slide off the surface into the ice storage bin 28.

In an embodiment, the control 98 may include a counter 114 (FIG. 6) to allow a time within ice freezing routines to be measured. In an automatic ice forming operation, once ice has been harvested from the ice forming surface 42, formation of a new batch of ice is initiated. This may occur by opening the water supply inlet valve 58 to fill the water collecting device to a predetermined level, or by using the flow sensor 60 to admit a predetermined volume of water, depending on the selected thickness of ice to be formed. The recirculating pump 48 is operated once the selected volume of water has been admitted through the water supply inlet valve. Once the water in the water collecting device 46 drops to the level 104, the ice harvesting routine may be initiated.

In the normal operation of the ice making device 20, as water is directed to the ice forming surface 42, some of the water engaging the surface freezes, while a remainder of the water flows from the surface through a collection funnel 115 (FIG. 10) and is returned to the water collecting device 46. If a frozen ice slab fails to release from the ice forming surface 42, for example due to a build up of minerals on the surface, when the next ice forming part of the operation begins, the water flowing over the remaining slab is diverted from flowing into the collection funnel 115, and instead flows through the ice storage bin 28 and into the drain. Therefore the water is not recirculated back to the water collecting device 46, and the water level in the water collecting device will be pumped down to the level 104 in less time than "normal," terminating the operation of the recirculating pump 48 and initiating a new ice harvesting operation. This will cause the counter 114 to be incremented. The counter is reset at the end of a clean cycle.

If the noted time is less than a "normal ice forming time," a counter will be incremented. In an embodiment, the control 98 may be arranged to generate an error signal upon detection of a predetermined number of instances that the time within ice freezing routines is outside of a predetermined range of times. For example, if a normal time for completing an ice forming cycle is about 10-12 minutes, if a first number of successive instances, say 5, are detected where the time between cycles is less than 10 minutes or more than 12 minutes, by a predetermined tolerance amount, then a warning signal, such as the illumination of a yellow LED 116, could be generated. If a further number of successive instances are detected, say 10, then a further warning signal, such as the illumination of a red LED 118, could be generated. Other visual signals, or audible signals, could be generated. A green LED 120 could be illuminated at those times when the yellow LED 116 and the red LED 118 are not illuminated. The user could be directed to clean the ice forming surface 42 upon the detection of a warning signal before calling for service of the appliance. It should be understood that the exemplar times and number of successive instance can be modified through a wide range to allow a particular ice making device 20 to operate automatically without giving excessive or erroneous warning signals.

In an embodiment, the refrigeration system 40 may comprise a compressor 122, an evaporator 124, and a condenser 126 connected by refrigerant lines 128. Other known types of refrigerant systems may also be utilized to chill the ice forming surface 42 below the freezing temperature of water.

The water supply inlet 44 may be connected directly to the water collecting device 46 and the water collecting device may comprise a water reservoir. The recirculating passage 52 may comprises a tube connected between the pump 48 and the ice forming surface 42. A water distributor 130 may be positioned between the recirculating passage 52 and the ice forming surface 42.

Figure 10:
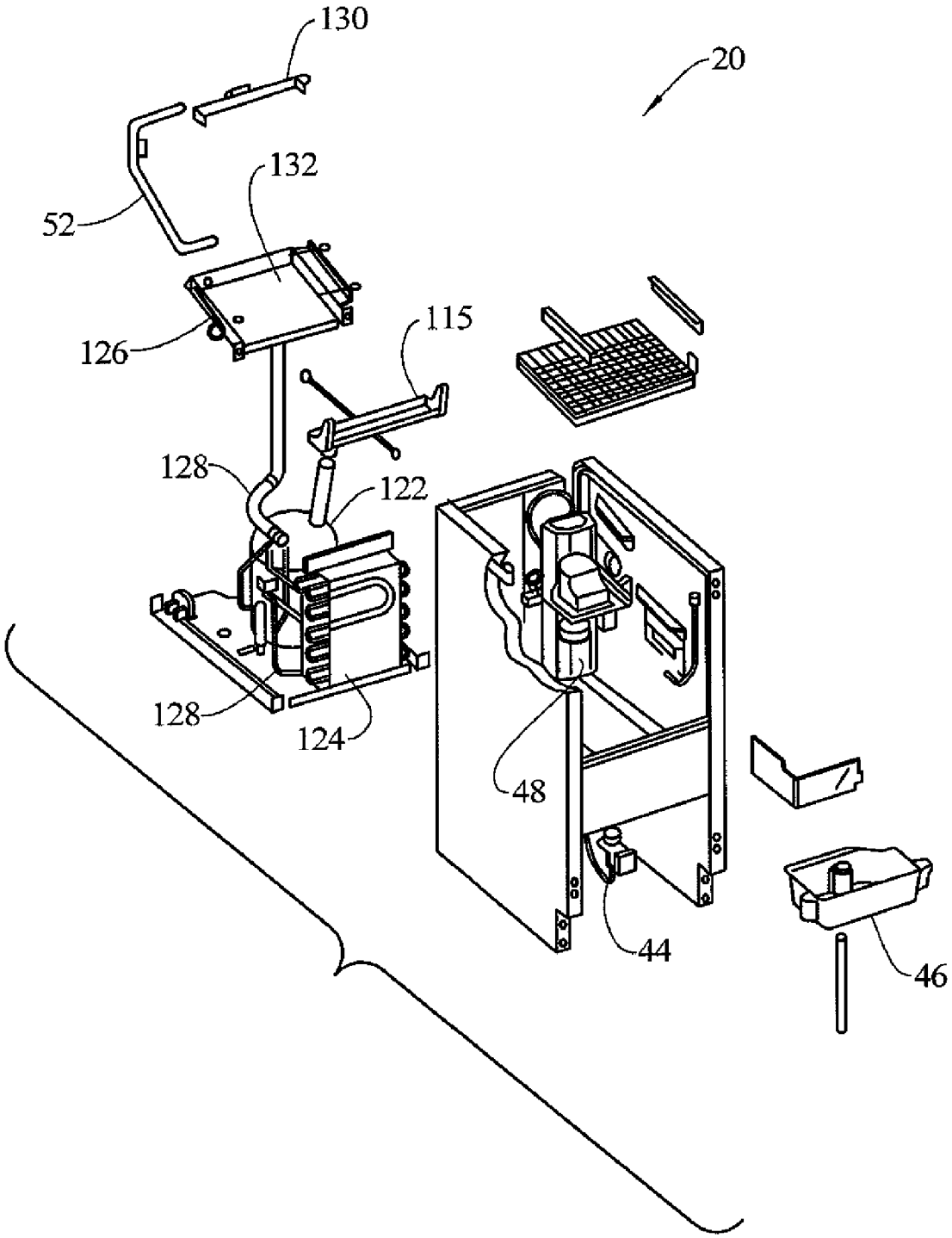
FIG. 10 is an exploded view of the interior components of the ice maker of FIG. 1.

A more detailed illustration of various interior components of a particular embodiment of the ice maker 20 embodying the principles of the present invention are shown in FIG. 10, including the refrigeration system 40 which may include the compressor 122, the condenser 126, the evaporator 124 and the series of refrigerant lines 128 connecting the compressor to the evaporator, the evaporator to the condenser and the condenser to the compressor. An evaporator plate 132 is thermally connected to the evaporator 124 and forms the ice forming surface 42.

The water supply inlet line 44 is connected to deliver water to the water collecting device 46 and the water collecting device is arranged to receive a flow of water from the evaporator plate 132, being the ice forming surface 42, through the collection funnel 115. The water distributor 130 is positioned to deliver a supply of water to the evaporator plate 132. The recirculating pump 48 has an inlet connected to the water collecting device 46 and an outlet connected to the recirculating passage 52. The recirculating passage 52 is connected to the water distributor 130.

Other components of the ice maker, which are known to those of skill in the art, but which do not pertain to the present invention are illustrated, but not described.

In an embodiment, a method of operating the ice maker 20 comprises the following steps:

A desired ice layer thickness may be set on the user interface 30 of the control 62 if such an arrangement is provided. For example, a thin layer, a thick layer and an intermediate thickness layer may be selected.

The water supply inlet valve 58 is opened to admit water from the water supply inlet 44. The admitted water is directed into the water collecting device 46. A volume of water being admitted through the water supply inlet 44 may be sensed and the water supply inlet valve 58 may be closed based upon the sensed volume of water admitted through the water supply inlet and the set desired ice layer thickness.

The ice forming surface 42 is cooled below the freezing temperature of water and water from the water collecting device 46 is pumped through the recirculating passage 52 to the ice forming surface 42 via the recirculating pump 48. Unfrozen water from the ice forming surface 42 is directed back to the water collecting device 46.

In an embodiment, a level of water in the water collecting device 46 may be sensed with a level sensor 72, and water may be pumped from the water collecting device 46 via the discharge pump 94 to the drain conduit 92, 102 based upon input from the level sensor. Further, operation of the discharge pump 94 may be terminated based upon an input from the level sensor 72.

In an embodiment, the step of pumping via the recirculating pump 48 and the step of pumping via the discharge pump 94 may utilize the same pump.

In an embodiment, the pump 48, 94 may be operated in a first direction to pump water to the ice forming surface 42, and the pump may be operated in a second, opposite direction to pump water to the drain conduit 92, 102.

In an embodiment, a level of water in the water collecting device 46 may be sensed with the level sensor 72, and an ice harvesting routine may be based upon input from the level sensor.

In an embodiment, a time within ice freezing routines may be measured, and a warning signal may be displayed when a measured time falls outside of a predetermined range.

The present invention has been described utilizing particular embodiments. As will be evident to those skilled in the art, changes and modifications may be made to the disclosed embodiments and yet fall within the scope of the present invention. For example, various components of different embodiments could be utilized separately or independently in some embodiments without using all of the other components described in a particular embodiment. Also, various components shown in one embodiment may be utilized with other components shown in different embodiments, even if such a particular combination of components is not illustrated in one of the depicted embodiments. The disclosed embodiments are provided only to illustrate aspects of the present invention and not in any way to limit the scope and coverage of the invention. The scope of the invention is therefore to be limited only by the appended claims.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. An ice maker comprising:

a refrigeration system for cooling an ice forming surface below a freezing temperature of water, a water supply inlet, a water supply inlet valve arranged to admit water from the water supply inlet when in an open position and to prevent admission of water from the water supply inlet when in a closed position, a flow sensor associated with the water supply inlet valve to determine a volume of water admitted through the water supply inlet, a control arranged to control a position of the water supply inlet valve based upon input from the flow sensor, a user interface associated with the control to permit a user to select different volumes of water to be admitted to a water collecting device through the inlet valve as sensed by the flow sensor, the water collecting device connected to receive a supply of water from the water supply inlet directly through the water supply inlet valve and without the water first contacting the ice forming surface and arranged to separately receive a flow of water from the ice forming surface, a level sensor associated with the water collecting device to determine a level of water in the water collecting device, a recirculating pump having an inlet connected to the water collecting device and an outlet, a recirculating passage connected at a first end to the outlet of the recirculating pump and arranged to direct water toward the ice forming surface, the control being arranged to initiate an ice harvesting routine based on input from the level sensor indicating that a level of water in the water collecting device has been reduced to a predetermined level, a drain outlet formed in the water collecting device, a drain flow control device communicating with the drain outlet and operated by the control to selectively discharge water from the water collecting device through the drain flow control device, and a drain conduit leading away from the drain flow control device.

2. An ice maker comprising:

a refrigeration system for cooling an ice forming surface below the freezing temperature of water, a water supply inlet, a water supply inlet valve arranged to admit water from the water supply inlet when in an open position and to prevent admission of water from the water supply inlet when in a closed position, a water collecting device connected to receive a supply of water directly from the water supply inlet and without the water first contacting the ice forming surface and arranged to separately receive a flow of water from the ice forming surface, a level sensor associated with the water collecting device to determine a level of water in the water collecting device, a recirculating pump having an inlet connected to the water collecting device and an outlet, a recirculating passage connected at a first end to the outlet of the recirculating pump and arranged to direct water toward the ice forming surface, a discharge pump having an inlet connected to the water collecting device and an outlet directed towards a drain, the recirculating pump and the discharge pump being one and the same, a control arranged to selectively operate the discharge pump based upon input from the level sensor indicating that a level of water in the water collecting device has been reduced to a predetermined value, a user interface associated with the control to permit a user to select different volumes of water to be admitted to the water collecting device through the inlet valve, and a valve on a downstream side of the pump, operated by the control, to selectively direct water from the pump to the ice forming surface when the level sensor indicates that a level of water in the water collecting device has been increased to a level conforming with the volume selected by the user or to a drain when the level sensor indicates that a level of water in the water collecting device has been reduced to a predetermined value.

3. An ice maker according to claim 2 wherein the pump is a reversible pump.

4. An ice maker according to claim 2, wherein the pump is a submersible pump positioned in the water collecting device.

5. An ice maker according to claim 2, wherein the control is further arranged to selectively operate the pump based on input from the level sensor when the level sensor indicates that the level of water in the water collecting device has been increased to a level conforming with the volume selected by the user.

6. An ice maker according to claim 2, wherein the control is further arranged to initiate an ice harvesting routine based on input from the level sensor when the level sensor indicates that a level of water in the water collecting device has been reduced to a predetermined value.

7. An ice maker according to claim 2, further including a water supply inlet valve with a flow sensor, the water supply inlet valve being arranged to admit water from the water supply inlet when in an open position and to prevent admission of water from the water supply inlet when in a closed position, and the control further being arranged to control a position of the water supply inlet valve based upon input from the flow sensor.

8. An ice maker comprising:

a refrigeration system for cooling an ice forming surface below the freezing temperature of water, a water supply inlet, a water collecting device connected to receive a supply of water directly from the water supply inlet and without the water first contacting the ice forming surface and arranged to separately receive a flow of water from the ice forming surface, a level sensor associated with the water collecting device to determine a level of water in the water collecting device, a recirculating pump having an inlet connected to the water collecting device and an outlet, a recirculating passage connected at a first end to the outlet of the recirculating pump and arranged to direct water toward the ice forming surface, a discharge pump having an inlet connected to the water collecting device and an outlet directed towards a drain, and a control arranged to selectively operate the discharge pump based upon input from the level sensor when the level sensor indicates that a level of water in the water collecting device has been reduced to a predetermined value, wherein the control includes a counter arranged to be incremented when a time within ice freezing routines is outside of a predetermined time range.

9. An ice maker according to claim 8, wherein the control is further arranged to generate an error signal upon detection of a predetermined number of instances of the time within ice freezing routines being outside of a predetermined time range.

10. An ice maker comprising:

a refrigeration system for cooling an ice forming surface below the freezing temperature of water, a water supply inlet, a water supply inlet valve arranged to admit water from the water supply inlet when in an open position and to prevent admission of water from the water supply inlet when in a closed position, a sensor arranged to determine a volume of water admitted through the water supply inlet, a control arranged to control a position of the water supply inlet valve based upon input from the sensor, a user interface associated with the control to permit a user to select different volumes of water to be admitted to a water collecting device through the inlet valve as sensed by the sensor, the water collecting device connected to receive a supply of water from the water supply inlet directly through the water supply inlet valve and without the water first contacting the ice forming surface and arranged to separately receive a flow of water from the ice forming surface, a level sensor associated with the water collecting device to determine a level of water in the water collecting device and communicating with the control, a recirculating pump having an inlet connected to the water collecting device and an outlet, a recirculating passage connected at a first end to the outlet of the recirculating pump and arranged to direct water toward the ice forming surface, a drain outlet in the water collecting device, a drain flow control device communicating with the drain outlet and operated by the control to selectively discharge water from the water collecting device through the drain flow control device when the level sensor indicates that a level of water in the water collecting device has been reduced to a predetermined value.

11. An ice maker according to claim 10, wherein the recirculating pump is a submersible pump positioned in the water collecting device.

12. An ice maker according to claim 10, wherein the control is further arranged to selectively operate the recirculating pump based on input from the level sensor when the level sensor indicates that a level of water in the water collecting device has been increased to a value corresponding with the volume selected by the user.

13. An ice maker according to claim 10, wherein the control is further arranged to initiate an ice harvesting routine based on input from the level sensor when the level sensor indicates that the level of water in the water collecting device has been reduced to the predetermined value.

14. An ice maker according to claim 10, wherein the control includes a counter arranged to be incremented when a time within ice freezing routines is outside of a predetermined time range.

15. An ice maker according to claim 14, wherein the control is further arranged to generate an error signal upon detection of a predetermined number of instances of the time within ice freezing routines being outside of a predetermined time range.

* * * * *